United States Patent [19]

Schlecht

[11] 4,418,713

[45] Dec. 6, 1983

[54] CONCRETE PUMP TRACTOR TRAILER ASSEMBLY

[76] Inventor: Karl Schlecht, Hainbuchenweg 47, 7000 Stuttgart 70, Fed. Rep. of Germany

[21] Appl. No.: 257,856

[22] Filed: Apr. 27, 1981

[30] Foreign Application Priority Data

Apr. 26, 1980 [DE] Fed. Rep. of Germany ..... 3016232

[51] Int. Cl.[3] ..... B62D 53/06; E04G 21/04

[52] U.S. Cl. ..... 137/351; 137/615; 137/899; 280/766.1

[58] Field of Search ..... 137/351, 615, 899, 899.3; 212/178, 195, 196, 197, 198; 280/765, 766

[56] References Cited

U.S. PATENT DOCUMENTS 3,357,573 12/1967 Stukins ..... 212/195
3,985,036 10/1976 Decker et al. ..... 212/189 X
4,130,134 12/1978 Castle ..... 137/615

FOREIGN PATENT DOCUMENTS 2729750 1/1979 Fed. Rep. of Germany ..... 137/899
2737884 3/1979 Fed. Rep. of Germany ..... 137/899

*Primary Examiner*—Gerald A. Michalsky
*Attorney, Agent, or Firm*—Toren, McGeady and Stanger

[57] ABSTRACT

A vehicular concrete pump assembly having a semitrailer and a truck tractor interconnected therewith with a mechanism being provided on the semitrailer for elevating the truck tractor and supporting it in the raised position while the semitrailer is braced on the ground by extendable support legs to enable the raised truck trailer to operate as ballast to stabilize the semitrailer against the weight of an articulated concrete distribution pole having a concrete line through which concrete is distributed by a pump on the semitrailer.

14 Claims, 7 Drawing Figures

CONCRETE PUMP TRACTOR TRAILER ASSEMBLY

The present invention relates generally to a tractor trailer assembly and more particularly to a vehicular assembly of this type operable as a concrete pump mechanism.

Concrete pumps of the type to which the present invention relates operate to convey concrete which has been delivered to a construction site by mixer trucks through a distribution pole or pipe to a formwork for the concrete. Customarily, concrete pumps are mounted on a truck chassis having two, three, or four axles and a continuous rigid frame. For very heavy vehicles having a total weight in excess of 24 tons (metric tons), as is the case with truck cranes, it becomes necessary to utilize a multi-axled heavy chassis having significantly higher axle load capability. Vehicles of this type are permitted on public streets only by special permit and they are usually not permitted to use roads or bridges which are of less solid construction.

Furthermore, it is known in apparatus of the type to which the present invention relates to utilize the semitrailer of the rig assembly as a chassis for the concrete pump and for a distribution pole for the concrete, as indicated in German Offenlegungsschrift No. 27 37 884. In the operating position wherein the distribution pole is activated and concrete is being conveyed, the semitrailer is unhitched. In order to afford necessary stability, the semitrailer must be provided with ballast which is formed with the assistance of a heavy access ramp for a re-mixer truck arranged forwardly of the concrete receiving hopper in the driving direction. A revolving turret of the distribution pole is accordingly arranged at the rear of the semitrailer.

With a larger construction of the distribution pole, the apparatus will approach the allowable weight limitation for semitrailer rigs which, for example, is currently 38 tons (metric tons) in the Federal Republic of Germany. In order to observe this weight limit in known semitrailer rigs, the distribution pole is limited to a maximum length of approximately 32 meters. Beyond this length there occurs a drawback in that the heavy ballast increases the costs of transportation.

The underlying task sought to be achieved by the present invention is to provide a semitrailer rig of the type previously discussed herein which may have a relatively light construction of the semitrailer without compromising stability and which may nevertheless achieve a considerable increase in the reach of the distribution mast without thereby exceeding a prescribed weight limit of the entire semitrailer rig.

SUMMARY OF THE INVENTION

Briefly, the present invention may be described as a vehicular pump assembly for conveying concrete at a construction site comprising a semitrailer, extendable support means for bracing the semitrailer at a ground location, an articulated concrete distribution pole including a concrete line for distribution of concrete, means operably mounting said distribution pole on said semitrailer rotatably about a generally vertical axis, concrete pump means on said semitrailer for pumping concrete to said concrete line, a truck tractor for driving said semitrailer, coupling means interconnecting said semitrailer and said truck tractor and raising and securing means on said semitrailer for elevating said truck tractor and supporting it in a raised position while said semitrailer is braced by said extandable support means thereby to enable utilization of said raised truck tractor as a ballast for stabilizing the semitrailer when the distribution pole is in the operative position.

As a result of the present invention, it is possible to achieve utilization of the weight of the truck tractor which drives the semitrailer, which weight may be about 7 to 9 tons, as suitable ballast for stabilizing the distribution pole.

Before the truck tractor is raised in the operation of the present invention, the outriggers or supporting legs provided on the semitrailer are pivoted outwardly into their prescribed supporting position and they are braced against the ground by means of a telescopic mechanism whereby the semitrailer may be raised. The forward support legs which face forwardly by an angle of about 45° with relation to the vehicle axis will appropriately reach in front of the forward axle of the semitrailer tractor. As a result of this extensive forward reach of the support legs, the semitrailer rig, which is longer by about 0.5 to 1 meter with relation to a vehicle having a rigid chassis, need not sacrifice advantage in terms of effective reach. This is due to the fact that unlike truck cranes, the forwardmost securing edge will not be embodied by the front axle but rather the connecting line between the ground contact points of the support legs extending approximately in the area of the bumper of the truck tractor. This also applies to a vehicle having a stationary common frame between concrete pump and motor drive, insofar as there are provided corresponding support legs that can be pivoted outwardly. However, the semitrailer rig has the advantage that unlike a single part vehicle, it is not limited to a total weight of 22 to 24 tons (metric) for driving without restrictions on public streets but rather to a total weight of 38 tons (metric) in a five-axle model and a total weight of up to 32 tons (metric) in a four-axle model. By means of an additional weight of 8 tons added to the truck tractor, there is made possible, with a bracing width of 8 meters, an increase in the load moment of the distribution pole of 30 to 40 meter-tons and thus a corresponding increase in its length. The use of a semitrailer rig with a three-axle truck tractor and with a two-axle semitrailer having a total weight of 38 tons makes feasible with a bracing width of about 8 meters a construction of the distribution pole with up to 44 meters height reach and about 40 meters horizontal reach. An equivalent one-piece, non-kneeling vehicle would require a five-axle special chassis which could only be utilized on public streets with severe route restrictions and special permits. Such restrictions are quite often unacceptable because of the high cost of transportation and other expenses especially where service industries are involved which are required to make a substantial number of calls daily. This restriction is eliminated by a construction in accordance with the present invention.

Thus far, commonly used three-axle vehicles with a non-kneeling chassis have involved a maximum total allowable weight which is currently about 24 tons for an unrestricted driving range in the Federal Republic of Germany. These vehicles can be equipped with distribution poles having a reach height of up to 32 meters. By comparison, a semitrailer rig with the features in accordance with the present invention and allowable total weight of 38 tons may have its reach height of the distribution pole increased by 12 meters to a total of 44 meters.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
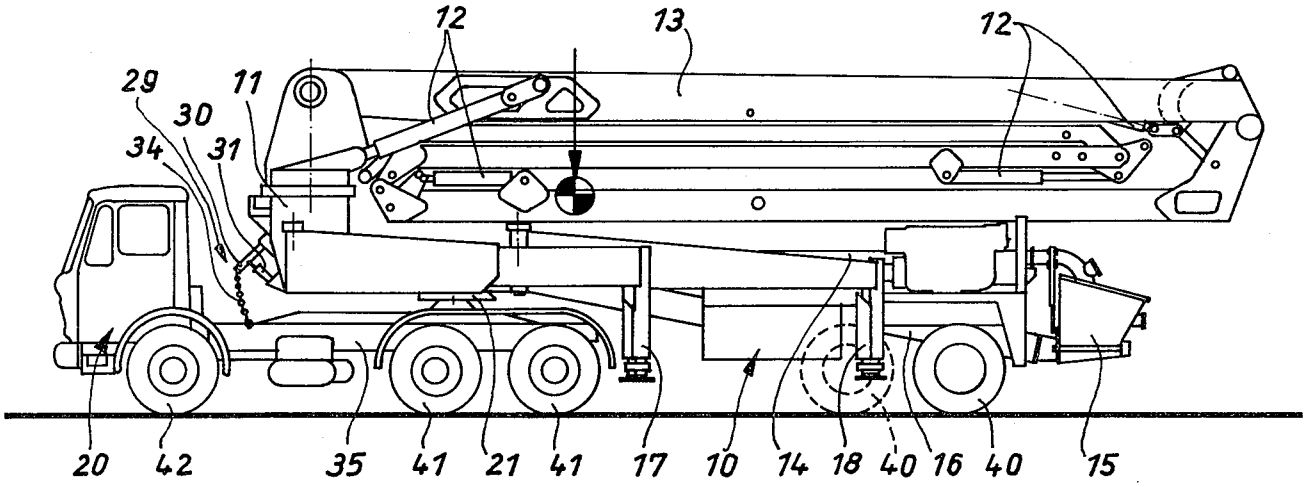
FIG. 1 is a side elevation showing a semitrailer rig with a concrete pump under on-street driving conditions with its supporting legs raised and with its distribution pole in the folded position.
Figure 2:
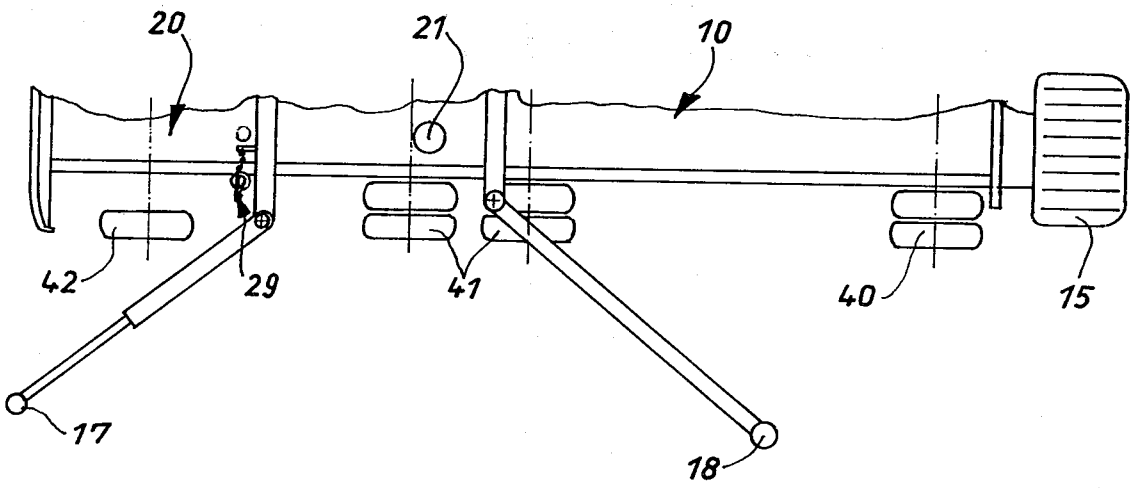
FIG. 2 is a partial top view of the apparatus shown in FIG. 1 with the supporting legs pivoted outwardly.

Referring now to the drawings, and in particular to FIG. 1, there is shown an apparatus which consists of a vehicular concrete pumping assembly which includes a semitrailer 10 having a revolving turret 11 and a turntable upon which there is arranged for rotatable movement about a vertical axis thereof a distribution pole 13 which may be unfolded into an extended position and which includes a concrete line 14 of the distribution pole 13 which can be supplied by means of a supply container 15 and a pump unit 16 with the concrete that is to be conveyed. The apparatus includes hydraulic means 12 for actuating the distribution pole 13 and at the semitrailer 10 there are provided a total of four supporting legs 17, 18 which are pivotable outwardly and laterally of the semitrailer and which are telescopically extendable downwardly, as indicated in FIG. 2.

The apparatus includes a truck tractor 20 which is detachably connected by means of a semitrailer hitch connection 21 with a kingpin 19 of the semitrailer 10. A locking member 22 assures that a vertical as well as a horizontal transfer of power may be achieved over a coupling and that the truck tractor may still be pivoted around the vertical axis of the kingpin 19 relative to the semitrailer 10.

For reasons of security, the locking member 22 may be attached to the semitrailer hitch connection 21 by means of a suitable screw connection in such a way that it cannot be easily removed by service personnel. A pivot bearing 23 which is additionally provided at the hitch connection permits pitching motion of the tractor 20 about a horizontal transverse axis relative to the semitrailer 10.

At the front end of the semitrailer 10 and functioning between the semitrailer and the tractor there are arranged lifting and gripping means 29 which are designated as the lifting mechanism.

In the examples of the embodiment shown in FIGS. 1–5, the lifting mechanism 29 comprises at least one lever 30 hinged onto the revolving turret 11 of the distribution pole 13 or onto the frame of the semitrailer 10. The lever 30 may be pivoted upwardly and downwardly by means of a hydraulic cylinder 31 around a horizontal axle extending transversely to the driving direction of the vehicle, as may be seen from FIG. 4. Instead of a single hydraulic cylinder 31, they may also be provided two such cylinders, with their lifting action being synchronized by means of a transverse bar 33 shown in FIG. 5.

At the free end of the lever 30, there are connected two pulling cables which may be constructed as link chains 34 having at their lower end an eye ring 37 which may be hung onto a set of bolts 36 projecting sideways over the chassis frame 35 of the truck tractor 20. The bolts 36 are arranged at a traverse 38 attached to the chassis frame 35, the traverse having a further set of bolts 39 at its central area located in the longitudinal central plane of the truck tractor. The link chains 34 serve as pulling members by means of which the tractor may be raised from the ground level with the assistance of the hydraulic cylinder 31 when the lever 30 is pivoted upwardly.

Figure 6:
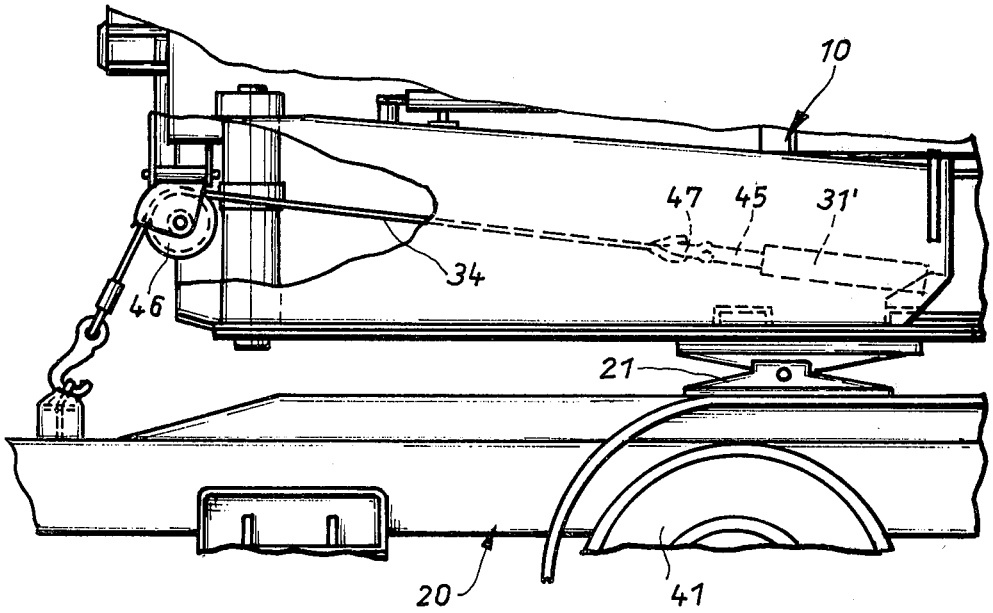
FIGS. 6 and 7 are partial side views of lifting mechanisms in accordance with further enbodiments of the invention.
Figure 7:
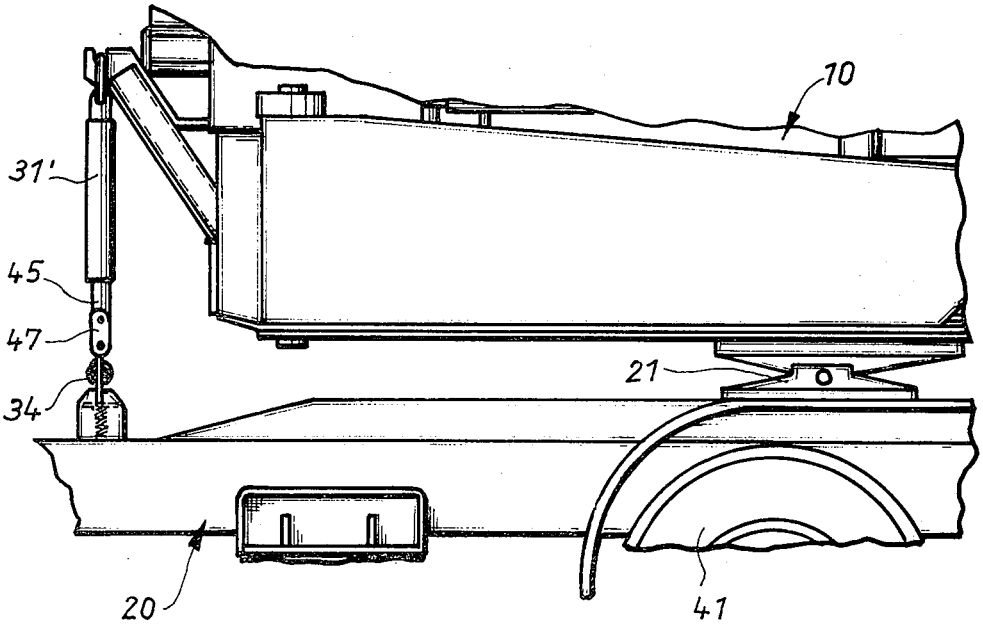

In the embodiments shown in FIGS. 6 and 7, the lifting mechanism 29 comprises a hydraulic cylinder 31' attached to the semitrailer 10 or to its superstructure, a piston rod 45 of the cylinder having a free end with an eyelet 47 or a hook to which there may be fastened the pulling member 34 structured as a chain or rope. Instead of one hydraulic cylinder 31', there may also be utilized a pair of hydraulic cylinders. In the embodiment shown in FIG. 6, the pliable pulling member 34 is guided around a guide pulley 46 located at the semitrailer.

In actual use, after the arrival of the semitrailer rig at a construction site, the semitrailer 10 with its superstructure consisting of the pump unit 16 and the distribution pole 13 is first raised in such a manner that the rear wheels 40 are substantially or totally lifted from the ground. Simultaneously, a double axle wheel set 41 of the truck tractor 30 is pulled up over the closed semitrailer coupling 21. The supporting legs 17 and 18 are thus situated roughly in the position indicated in FIG. 2.

The lifting mechanism 29 is then activated. In a case where the truck tractor 20 upon arrival at a construction site is not positioned exactly in alignment with the semitrailer 10, the link chains 34 are hung on the middle kingpin or bolt 39 at the start of operation. Subsequently, upon activation of the hydraulic cylinders 31 or 31', the front part of the truck tractor 20 is raised slightly and once the front wheels 42 are lifted, the forward part of the truck tractor will be straightened into alignment with the semitrailer 10. Upon renewed lowering of the tractor, the link chains 34 may be hung onto the bolts 36 projecting sideways. With subsequent activation of the hydraulic cylinder 31 or 31', the tractor is lifted off the ground by its front wheels and with the rear wheels being lifted off the ground as well it will function as a ballast for stabilizing the weight of the semitrailer when the distribution pole is in its extended or unfolded condition.

In order to avoid undesired oscillations in the truck tractor 20 during pivoting of the heavy distribution pole 13, the tractor may be locked in the aligned position. This may be accomplished by means of a wedge of the type known in the art and not depicted in the drawings which may be hydraulically inserted into the entry slot of the trailer hitch connection 21. For this purpose, there may be further provided, between the semitrailer 10 and the chassis 35 of the tractor 20, additional hydraulic cylinders (not shown). With the assistance of firm pull rods, triangular steering control arms or the like instead of the link chains, there can also be effected a fixing of the raised truck tractor in relation to the semitrailer.

Figure 3:
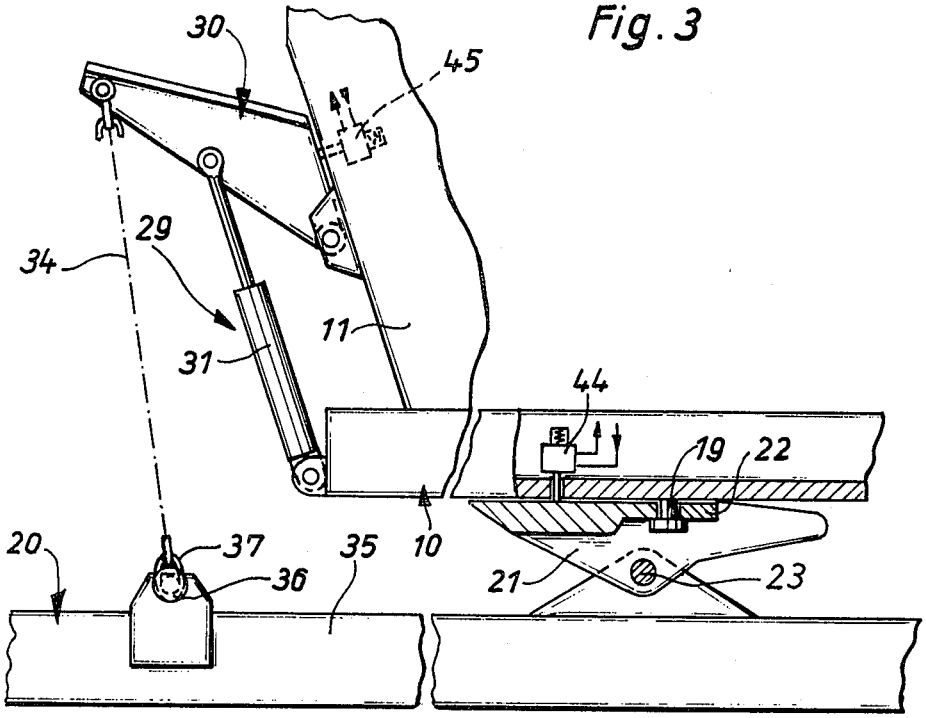
FIG. 3 is an enlarged detail view of a part of the apparatus of FIG. 1 showing a preferred lifting mechanism in accordance with the present invention.
Figure 4:
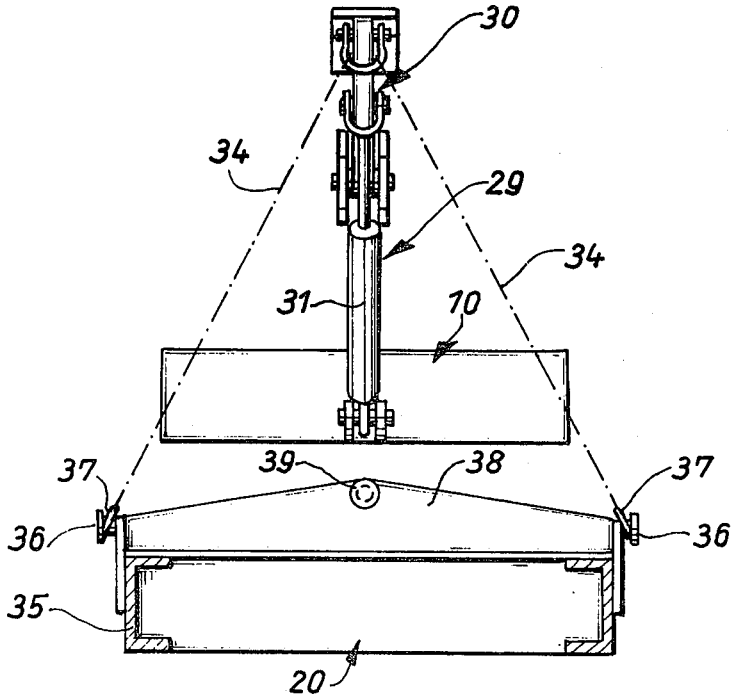
FIG. 4 is a front view of the lifting mechanism according to FIG. 3.
Figure 5:
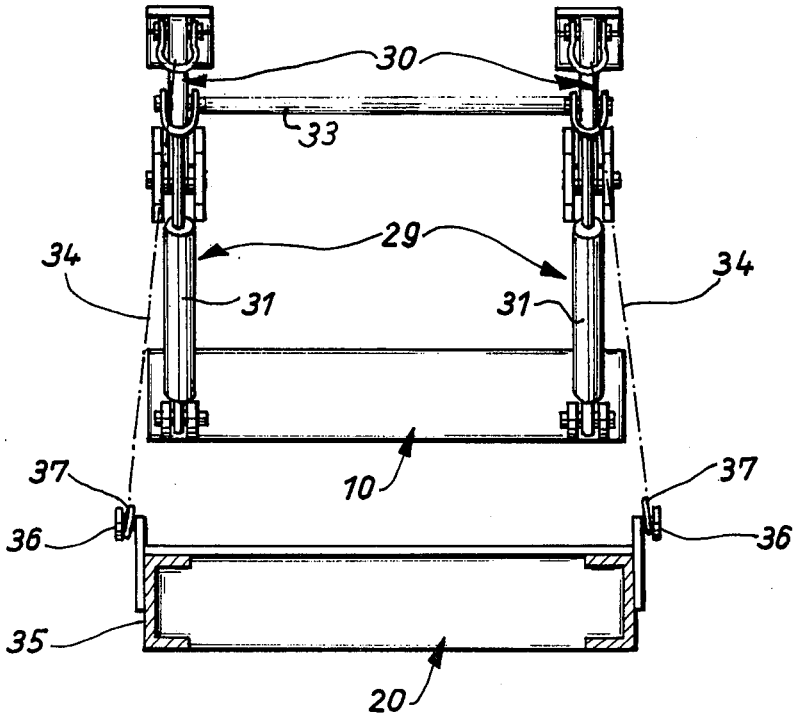
FIG. 5 is a front view of a lifting mechanism similar to that of FIG. 3 wherein two hydraulic cylinders are utilized.

In order to prevent accidental extension of the distribution pole with an insufficient ballast weight, there is provided a safety device which prevents the supply of pressure oil to the hydraulic system of the distribution pole when the semitrailer is unhitched and/or when the truck tractor is not raised from the ground. For this purpose, two pilot valves 44 and 45 are arranged at the semitrailer which are constructed as breech-mechanisms, the pilot valves being activated in one case by means of a coupling plate of the semitrailer coupling 21 and in another case by means of the lever 30 in the upwardly pivoted end position of this lever (FIG. 3). Of course, the safety function may be achieved in a different manner, for example, by a pressure-activated switching valve connected to the hydrocylinder 31 and responsive to the load of the raised truck tractor.

The link chains 34 make it possible to pivot the tractor back into its original position at an angle relative to the semitrailer after work operation is stopped. This may be accomplished by hanging the chains 34 after a brief lowering of the front part of the tractor 20 onto another point of the chassis frame 35 or the traverse 38 in such a way that the tractor, when it is again raised, may be pivoted to the desired side relative to the semitrailer. The semitrailer rig can then be driven backwardly while aligned in its original direction in order to enable it to leave the construction site. This is particularly advantageous where narrow construction sites are involved.

In order to dispense with the need for a separate motor on the semitrailer, it is possible to employ the vehicle motor of the tractor 20 for driving the pump unit 16. This can be accomplished with the help of movable flexible hydraulic lines between the truck tractor and the semitrailer.

Another possibility involves engaging a mechanical clutch between the truck tractor and the semitrailer in the operating position when the truck tractor is raised. The clutch may frictionally connect by way of a cardan shaft a hydropump arranged on the semitrailer with the automotive engine of the tractor. Because of the pump power which is required, this will however make necessary a powerful automotive engine in the truck tractor. Moreover, there will then apply a restriction in that the semitrailer can no longer be utilized in connection with any desired truck tractor.

With the lifting mechanism described above, it is also fundamentally possible, in the unhitched condition of the rig, to lift another ballast weight instead of the truck tractor. This is advantageous, for example, when the truck tractor must be used elsewhere or is in repair. Furthermore, the out-of-service times of the concrete pump at the construction site may thereby be avoided.

Instead of a hydrocylinder 31, 31', there may also be utilized as the lifting mechanism a winch, not shown in the drawings. If a winch is arranged in the rearward area of the semitrailer 10 in the vicinity of the supply container 15, it may be used, if necessary, also as a two winch for the vehicle.

It is also possible to provide an arrangement wherein the semitrailer 10 and the truck tractor 20 are connected only with a tautened pulling member in such a manner that lifting of the truck tractor may be effected without any additional lifting mechanism once the forward outriggers have been extended.

While specific embodiments of the invention have been shown and described in detail to illustrate the application of the inventive principles, it will be understood that the invention may be embodied otherwise without departing from such principles.

What is claimed is:

1. A vehicular concrete pumping rig for conveying concrete at a construction site comprising: a semitrailer; extendable support means for bracing said semitrailer at a ground location; an articulated concrete distribution pole including a concrete line for distribution of concrete; means operably mounting said distribution pole on said semitrailer rotatably about a generally vertical axis; concrete pump means on said semitrailer for pumping concrete to said concrete line; a truck tractor for driving said semitrailer; coupling means interconnecting said semitrailer and said tractor; and raising and securing means on said semitrailer for elevating said truck tractor and supporting it in a raised position while said semitrailer is braced by said extendable support means thereby to enable utilization of said raised truck tractor as ballast to stabilize said semitrailer against the weight of said distribution pole, said raising and securing means comprising at least one pulling member located forwardly of said coupling means taken in the driving direction of said rig, said pulling member being adapted to be fastened between said semitrailer and at least one location on said truck tractor, said location being situated lower than said semitrailer, said truck tractor being thereby adapted to be raised entirely off the ground with front and rear wheels thereof when said coupling means is engaged and when said extendable support means are extended.

2. A rig according to claim 1 wherein said raising and securing means further comprise at least one lever hinged on said semitrailer, said lever being pivotable by means of at least one hydraulic cylinder around a horizontal axis extending transversely to the driving direction of said rig, said lever being connectable with an end of said pulling member on the side of said semitrailer.

3. A rig according to claim 1 wherein said raising and securing means comprise at least one hydraulic cylinder hinged on said semitrailer and in direct engagement with said pulling member.

4. A rig according to claim 3 wherein said pulling member is of a flexible construction, wherein a pulley is provided hanging from said semitrailer to guide said pulling member, and wherein said rig comprises a hydraulic cylinder hinged at a lower area of said semitrailer, said pulling member being guided by said pulley to extend from engagement with said truck tractor to said hydraulic cylinder.

5. A rig according to claim 1 wherein said pulling member may be connected with said truck tractor in order to raise said truck tractor from the ground, said extendable support means comprising forward support legs which are extendable in the driving direction to assist in raising said truck tractor.

6. A rig according to claim 1 wherein said pulling member is constructed as a link chain.

7. A rig according to claim 1 wherein said pulling member consists of at least one rigid pulling rod.

8. A rig according to claim 1 wherein said pulling member consists of a triangular steering control arm.

9. A rig according to claim 1 wherein on said truck tractor there are provided a pair of attachment points for said pulling member located symmetrically relative to a longitudinal vertical plane extending centrally through said truck tractor, said pulling member including two parts arranged to extend downwardly for engagement with said attachment points.

10. A rig according to claim 9 wherein there is provided on said truck tractor a further attachment point arranged approximately at said vertical longitudinal central plane.

11. A rig according to claim 1 wherein said truck tractor may be aligned in the longitudinal direction of said semitrailer when said truck tractor is in the position raised off the ground by said raising and securing means and wherein in said aligned position said truck tractor may be secured to said semitrailer by means including a blocking wedge adapted to be inserted into said coupling means.

12. A vehicular concrete pumping rig for conveying concrete at a construction site comprising: a semitrailer; extendable support means for bracing said semitrailer at a ground location; an articulated concrete distribution pole including a concrete line for distribution of concrete; means operably mounting said distribution pole on said semitrailer rotatably about a generally vertical axis; concrete pump means on said semitrailer for pumping concrete to said concrete line; a truck tractor for driving said semitrailer; coupling means interconnecting said semitrailer and said tractor; and raising and securing means on said semitrailer for elevating said truck tractor and supporting it in a raised position while said semitrailer is braced by said extendable support means thereby to enable utilization of said raised truck tractor as ballast to stabilize said semitrailer against the weight of said distribution pole, said rig further comprising a hydraulic system for operating said distribution pole, said rig also including a safety mechanism blocking pressure oil supply to said hydraulic system of said distribution pole when said semitrailer and said truck tractor are not interconnected by said coupling means and when said truck tractor is not raised by said raising and securing means.

13. A rig according to claim 12 wherein said safety mechanism contains a safety switch constructed as a hydraulic terminal switch valve, said safety switch being in its nonblocking condition in the upper end positon of said raising and securing means and when said semitrailer and said truck tractor are interconnected by said coupling means.

14. A vehicular concrete pumping rig for conveying concrete at a construction site comprising: a semitrailer; extendable support means for bracing said semitrailer at a ground location; an articulated concrete distribution pole including a concrete line for distribution of concrete; means operably mounting said distribution pole on said semitrailer rotatably about a generally vertical axis; concrete pump means on said semitrailer for pumping concrete to said concrete line; a truck tractor for driving said semitrailer; coupling means interconnecting said semitrailer and said tractor; and raising and securing means on said semitrailer for elevating said truck tractor and supporting it in a raised position while said semitrailer is braced by said extendable support means thereby to enable utilization of said raised truck tractor as ballast to stabilize said semitrailer against the weight of said distribution pole, said generally vertical axis about which said distribution pole is rotatably mounted and said raising and securing means being arranged on said semitrailer in the vicinity of said coupling means.

* * * * *